US009827647B2

(12) United States Patent
Lee et al.

(10) Patent No.: US 9,827,647 B2
(45) Date of Patent: Nov. 28, 2017

(54) RETAINER RING FOR CHEMICAL-MECHANICAL POLISHING DEVICE

(71) Applicant: WILL BE S & T CO., LTD., Hwaseong-si, Gyeonggi-do (KR)

(72) Inventors: Jae-Bok Lee, Osan-si (KR); Jun-Je Lee, Hwaseong-si (KR)

(73) Assignee: WILL BE S & T CO., LTD., Hwaseong-si (KR)

( * ) Notice: Subject to any disclaimer, the term of this patent is extended or adjusted under 35 U.S.C. 154(b) by 39 days.

(21) Appl. No.: 14/904,094

(22) PCT Filed: Jul. 10, 2014

(86) PCT No.: PCT/KR2014/006185

§ 371 (c)(1),
(2) Date: Jan. 9, 2016

(87) PCT Pub. No.: WO2015/005687

PCT Pub. Date: Jan. 15, 2015

(65) Prior Publication Data

US 2016/0158910 A1 Jun. 9, 2016

(30) Foreign Application Priority Data

Jul. 11, 2013 (KR) ..... 10-2013-0081684

(51) Int. Cl.
*B24B 37/32* (2012.01)

(52) U.S. Cl.
CPC ..... *B24B 37/32* (2013.01)

(58) Field of Classification Search
CPC ..... B24B 37/32
USPC ..... 451/41, 285–290, 398
See application file for complete search history.

(56) References Cited

U.S. PATENT DOCUMENTS 5,645,474 A * 7/1997 Kubo ..... B25B 11/005 451/287
9,337,075 B2 * 5/2016 Yen ..... H01L 21/68721
2013/0324017 A1 * 12/2013 Rahmathullah ..... B24B 37/32 451/398

FOREIGN PATENT DOCUMENTS

| | | | |
|---|---|---|---|
| JP | 2010-010351 | A | 1/2010 |
| KR | 10-2003-0001526 | A | 1/2003 |
| KR | 10-0869549 | B1 | 9/2007 |
| KR | 10-0874275 | B1 | 12/2008 |
| KR | 10-2010-0067180 | A | 6/2010 |
| KR | 10-2010-0137303 | A | 12/2010 |

* cited by examiner

*Primary Examiner* — George Nguyen
(74) *Attorney, Agent, or Firm* — Maschoff Brennan

(57) ABSTRACT

A retainer ring for a chemical-mechanical polishing device. The ring prevents damage that occur during polishing work and being usable in stable fashion up until a predetermined lifespan has elapsed, by ensuring that a first ring body mounted on the chemical-mechanical polishing device and a second ring body making contact with a polishing pad are firmly coupled together by means of securing bodies which pass through coupling holes in the first ring body and are coupled to recessed coupling parts in the second ring body, and also by means of adhesive parts which are provided in the coupling holes or the recessed coupling parts and adhere and secure the securing bodies.

19 Claims, 5 Drawing Sheets

RETAINER RING FOR CHEMICAL-MECHANICAL POLISHING DEVICE

TECHNICAL FIELD

The present invention generally relates to a method of fabricating a ceramic device and a ceramic device. More particularly, the present invention relates to a retainer ring of a chemical-mechanical polishing device. Further more particularly, the present invention relates to a retainer ring of a chemical-mechanical polishing device that accommodates a wafer when the wafer is polished using the chemical-mechanical polishing apparatus.

The present application claims the benefit of Korean Patent Application No. 10-2013-0081684 filed on Jul. 11, 2013, the entire contents of which are incorporated herein for all purposes.

BACKGROUND ART

In general, a semiconductor wafer is subjected to surface planarization using a chemical-mechanical polishing apparatus.

The chemical-mechanical polishing apparatus is an apparatus for polishing an oxide film or a thin metal film applied on a semiconductor wafer using a chemical action and a physical action, thereby planarizing or removing the oxide film or the thin metal film.

As illustrated in FIG. 1, the chemical-mechanical polishing apparatus includes a rotatable polishing head 5, a polishing pad 6, and an abrasive-supplying part. The polishing head 5 is connected to a motor, and has a wafer-accommodating portion in the bottom thereof, the wafer-accommodating portion accommodating a semiconductor wafer 7 therein. The polishing pad 6 is disposed on the bottom of the polishing head 5 polishes the surface of the semiconductor wafer 7 accommodated in the polishing head 5. The abrasive-supplying part supplies a chemical abrasive to the polishing pad 6.

In addition, a retainer ring 1 defining the wafer-accommodating portion is mounted to the lower portion of the polishing head 5.

The retainer ring 1 includes a first ring body 1*a* mounted on the carrier of the polishing head 5 and a second ring body 1*b* coupled to the lower portion of the first ring body 1*a*. The second ring body 1*b* has a plurality abrasive supply holes in the bottom surface, and adjoins the abrasive pad 6.

The first ring body 1*a* and the second ring body 1*b* are coupled and integrated by bonding using an adhesive.

The first ring body 1*a* is formed of a metal material, such as stainless steel (SUS), and the second ring body 1*g* is formed of an engineering plastic.

The retainer ring 1 is fabricated according to a variety of specifications according to the type of chemical-mechanical polishing apparatus to which the retainer ring 1 is mounted, and is fabricated according to the specifications of the corresponding chemical-mechanical polishing apparatus.

That is, during the chemical-mechanical polishing operation performed within the wafer-accommodating portion of the polishing head 5, the outer circumferential surface of the semiconductor wafer 7 is caught by the inner circumferential surface of the retainer ring 1 such that the semiconductor wafer 7 is not dislodged from the polishing head 5.

In addition, the chemical abrasive slurry supplied to the polishing pad by the abrasive-supplying part enters the semiconductor wafer-accommodating portion through the abrasive supply holes to oxidize the surface of the semiconductor wafer.

The chemical-mechanical polishing apparatus planarizes the surface of the semiconductor wafer by repeatedly performing a chemical oxidation operation using the slurry and a polishing operation. In the polishing operation, the polishing head and the polishing pad rotate to polish the surface of the semiconductor wafer in contact with the polishing pad.

At present, for chemical-mechanical polishing apparatuses, required is a retainer ring that can be reliably and firmly mounted on the polishing head 5. The weight or height of the retainer ring needs to be preset to minimize vibration due to the contact with the polishing pad.

The retainer ring 1 is fabricated by increasing the thickness of the first ring body 1*a* formed of a metal material in order to obtain the specifications, such as the preset weight and height.

However, the retainer ring 1 is mounted on the polishing head 5 such that only the first ring body 1*a* formed of a metal material is fastened with bolts. This decreases the bonding force of the portions to which the second ring body 1*a* is bonded, thereby failing to reliably support the semiconductor wafer 7. Thus, scratches may be formed on the surface of the semiconductor wafer 7, and in severe cases, accidents in which the semiconductor wafer 7 is broken during the chemical-mechanical polishing operation may frequently occur.

In addition, the retainer ring 1 fabricated by bonding the first ring body 1*a* and the second ring body 1*b* is subjected to the following problems: While the retainer ring 1 is being polished, a bonding material may frequently leak to the outer circumference. The leaked bonding material frequently forms scratches on the surface of the semiconductor wafer 7 while the cured bonding material is being detached.

DISCLOSURE

Technical Problem

Accordingly, the present invention has been made keeping in mind the above problems occurring in the related art, and the present invention is intended to propose a retainer ring of a chemical-mechanical polishing apparatus able to be fabricated by being simply assembled and allow for a reliable polishing operation.

Technical Solution

In order to achieve the above object, according to one aspect of the present invention, there is provided a retainer ring disposed on a chemical-mechanical polishing apparatus and enclosing a wafer accommodated therein. The retainer ring includes: a first ring body disposed on the chemical-mechanical polishing apparatus, the first ring body having engagement holes formed in a top-bottom direction; a second ring body disposed on a bottom surface of the first ring body, the second ring body having engagement recesses connected to the plurality of engagement holes; and fixing members extending through the engagement holes and engaged with the engagement recesses, thereby mounting the second ring body to the first ring body.

According to the present invention, the fixing members may include fixing bolt members that are fastened with the engagement recesses through the engagement holes.

According to the present invention, the retainer ring may further include bonding parts disposed within the engagement holes or the engagement recesses, the bonding parts fixing the fixing members by being bonded thereto.

According to the present invention, each of the bonding parts may include an upper bonding portion disposed in a space defined between an inner circumferential surface of a corresponding engagement hole of the engagement holes and an outer circumferential surface of a corresponding fixing member of the fixing members.

According to the present invention, each of the fixing members may include a head on a top end thereof. The first ring body may include head-accommodating portions in upper portions thereof, each of the head-accommodating portions communicating with a corresponding engagement hole of the engagement holes, and accommodating the head therein, an inner diameter of the head-accommodating portion being greater than an outer diameter of the head. Each of the bonding parts may include a head-bonding portion disposed between an inner circumferential surface of the head-accommodating portion and an outer circumferential surface of the head.

According to the present invention, each of the bonding parts may include a lower bonding portion disposed in a space defined between a bottom end of a corresponding fixing member of the fixing members and a bottom surface of a corresponding engagement hole of the engagement holes.

According to the present invention, each of the fixing members may include a head on a top end thereof. The first ring body may include head-accommodating portions in upper portions thereof, each of the head-accommodating portions communicating with a corresponding engagement hole of the engagement holes, and accommodating the head therein, an inner diameter of the head-accommodating portion being greater than an outer diameter of the head. Each of the bonding parts may include: an upper bonding portion disposed between an inner circumferential surface of a corresponding engagement hole of the engagement holes and an outer inner circumferential surface of a corresponding fixing member of the fixing members; a head-bonding portion disposed between an inner circumferential surface of the head-accommodating portion and an outer circumferential surface of the head; and a lower bonding portion disposed in a space defined between a bottom end of a corresponding fixing member of the fixing members and a bottom surface of a corresponding engagement recess of the engagement recesses.

According to the present invention, protrusions may be formed on lower portions of the first ring body or upper portions of the second ring body, the protrusions respectively communicating with the engagement holes or the engagement recesses. Protrusion-accommodating recesses may be formed in the upper portions of the second ring body or the lower portions of the first ring body, the protrusion-accommodating recesses respectively communicating with the engagement recesses or the engagement holes, and respectively accommodating the protrusions therein.

According to the present invention, each of the bonding parts may include: a first protrusion-bonding portion disposed between an upper surface or a lower surface of a corresponding protrusion of the protrusions and an inner surface of a corresponding protrusion-accommodating recess of the protrusion-accommodating recesses; and a second protrusion-bonding portion disposed between an outer surface of the protrusion and an inner surface of the protrusion-accommodating recess.

According to the present invention, each of the fixing members may include a head on a top end thereof. The first ring body may include head-accommodating portions in upper portions thereof, each of the head-accommodating portions communicating with a corresponding engagement hole of the engagement holes, and accommodating the head therein, an inner diameter of the head-accommodating portion being greater than an outer diameter of the head. Protrusions may be formed on lower portions of the first ring body or upper portions of the second ring body, the protrusions respectively communicating with the engagement holes or the engagement recesses, protrusion-accommodating recesses may be formed in the upper portions of the second ring body or the lower portions of the first ring body, the protrusion-accommodating recesses respectively communicating with the engagement recesses or the engagement holes, and respectively accommodating the protrusions therein. Each of the bonding parts may include: an upper bonding portion disposed between an inner circumferential surface of a corresponding engagement hole of the engagement holes and an outer inner circumferential surface of a corresponding fixing member of the fixing members; a head-bonding portion disposed between an inner circumferential surface of the head-accommodating portion and an outer circumferential surface of the head; a lower bonding portion disposed in a space defined between a bottom end of a corresponding fixing member of the fixing members and a bottom surface of a corresponding engagement recess of the engagement recesses; a first protrusion-bonding portion disposed between an upper surface or a lower surface of a corresponding protrusion of the protrusions and an inner surface of a corresponding protrusion-accommodating recess of the protrusion-accommodating recesses; and a second protrusion-bonding portion disposed between an outer surface of the protrusion and an inner surface of the protrusion-accommodating recess.

According to the present invention, the fixing members may be respectively engaged with the engagement recesses, respectively forming a space between an outer circumferential surface of each of the fixing members and an inner circumferential surface of a corresponding engagement hole of the engagement holes.

According to the present invention, each of the fixing members may include a head on a top end thereof, the first ring body includes head-accommodating portions in upper portions thereof, each of the head-accommodating portions communicating with a corresponding engagement hole of the engagement holes, and accommodating the head therein, an inner diameter of the head-accommodating portion being greater than an outer diameter of the head. The fixing member may be engaged with a corresponding engagement recess of the engagement recesses, forming a space between an outer circumferential surface of the head and an inner circumferential surface of the head-accommodating portion.

According to the present invention, protrusions may be formed on lower portions of the first ring body or upper portions of the second ring body, the protrusions respectively communicating with the engagement holes or the engagement recesses, protrusion-accommodating recesses are formed in the upper portions of the second ring body or the lower portions of the first ring body, the protrusion-accommodating recesses respectively communicating with the engagement recesses or the engagement holes, and respectively accommodating the protrusions therein. The fixing members are respectively engaged with the engagement recesses, respectively forming a space between an outer circumferential surface of each of the protrusions and an inner circumferential surface of a corresponding protrusion-accommodating portion of the protrusion-accommodating portions.

According to the present invention, the retainer ring may further include an O-ring interposed between the first ring body and the second ring body.

According to the present invention, the O-ring may be disposed on at least one side of an inner side and an outer side of the first ring body and the second ring body with respect to portions with which the fixing members are engaged.

According to the present invention, the O-rings may be disposed on both the inner side and the outer side of the first ring body and the second ring body with respect to the portions with which the fixing members are engaged.

According to the present invention, the retainer ring may further include a position-fixing member fixing the first ring body and the second ring body in position such that the engagement holes communicate with the engagement recesses. A portion of the position-fixing member may be fitted into the first ring body and a remaining portion of the position-fixing member is fitted into the second ring body.

According to the present invention, an inner diameter of the engagement holes may be greater than an inner diameter of the engagement recesses. The position-fixing member may fix the first ring body and the second ring body in position such that the engagement recesses are respectively concentric with the engagement holes.

According to the present invention, the position-fixing member may have a cylindrical shape, with opposite radial ends thereof being spaced apart from each other, the opposite radial ends spaced apart from each other impart elasticity to the position-fixing member.

According to the present invention, the position-fixing member may include teeth on the opposite radial ends spaced apart from each other, the teeth on one of the opposite radial ends engaging with the teeth on the other one of the opposite radial ends.

Advantageous Effects

The retainer ring of a chemical-mechanical polishing apparatus according to the present invention allows the ring body mounted to the polishing head and the ring body in contact with the polishing pad to be simply and firmly assembled, thereby reducing the fabrication cost of the retainer ring and improving the productivity of the retainer ring.

The retainer ring of a chemical-mechanical polishing apparatus according to the present invention allows the ring body mounted to the polishing head and the ring body in contact with the polishing pad to be firmly fixed, thereby preventing damage to a semiconductor wafer during polishing. In addition, the retainer ring can be reliably used for the predetermined lifespan thereof.

Figure 1:
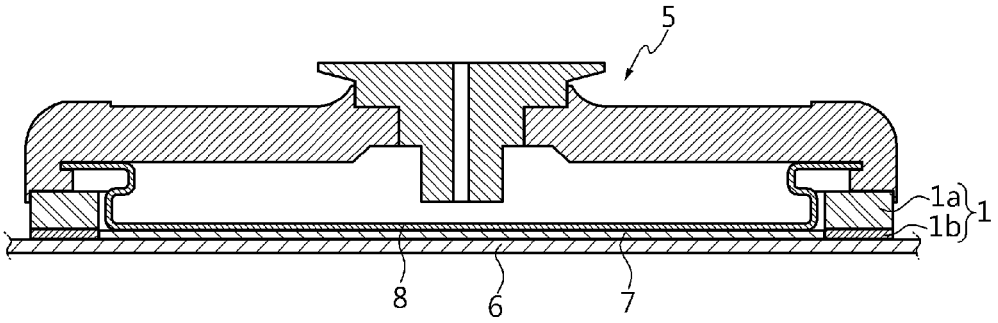
FIG. 1 is a cross-sectional view schematically illustrating a polishing head on which a retainer ring of the related art is mounted.

<Description of the Reference Numerals in the Drawings>

| | |
|---|---|
| 10: first ring body | 11: coupling hole |
| 13: head-accommodating portion | 20: second ring body |
| 21: engagement recess | 30: fixing member |
| 31: fixing bolt member | 40: bonding part |
| 41: upper bonding portion | 42: lower bonding portion |
| 43: head-bonding portion | |
| 44: first protrusion- bonding portion | |
| 45: second protrusion- bonding portion | |
| 50: position-fixing member | |

BEST MODE

Exemplary embodiments of the present invention will now be described in detail with reference to the accompanying drawings. In the following description of the present invention, detailed descriptions of known functions and components incorporated herein will be omitted in the case that the subject matter of the present invention may be rendered unclear thereby. These embodiments are provided so that this disclosure will fully convey the scope of the invention to those skilled in the art. In the drawings, the shapes and dimensions of components may be exaggerated for the sake of clarity.

The present invention relates to a retainer ring of a chemical-mechanical polishing apparatus. The retainer ring is mounted on a chemical-mechanical polishing apparatus, and encloses a wafer accommodated therein.

Figure 2:
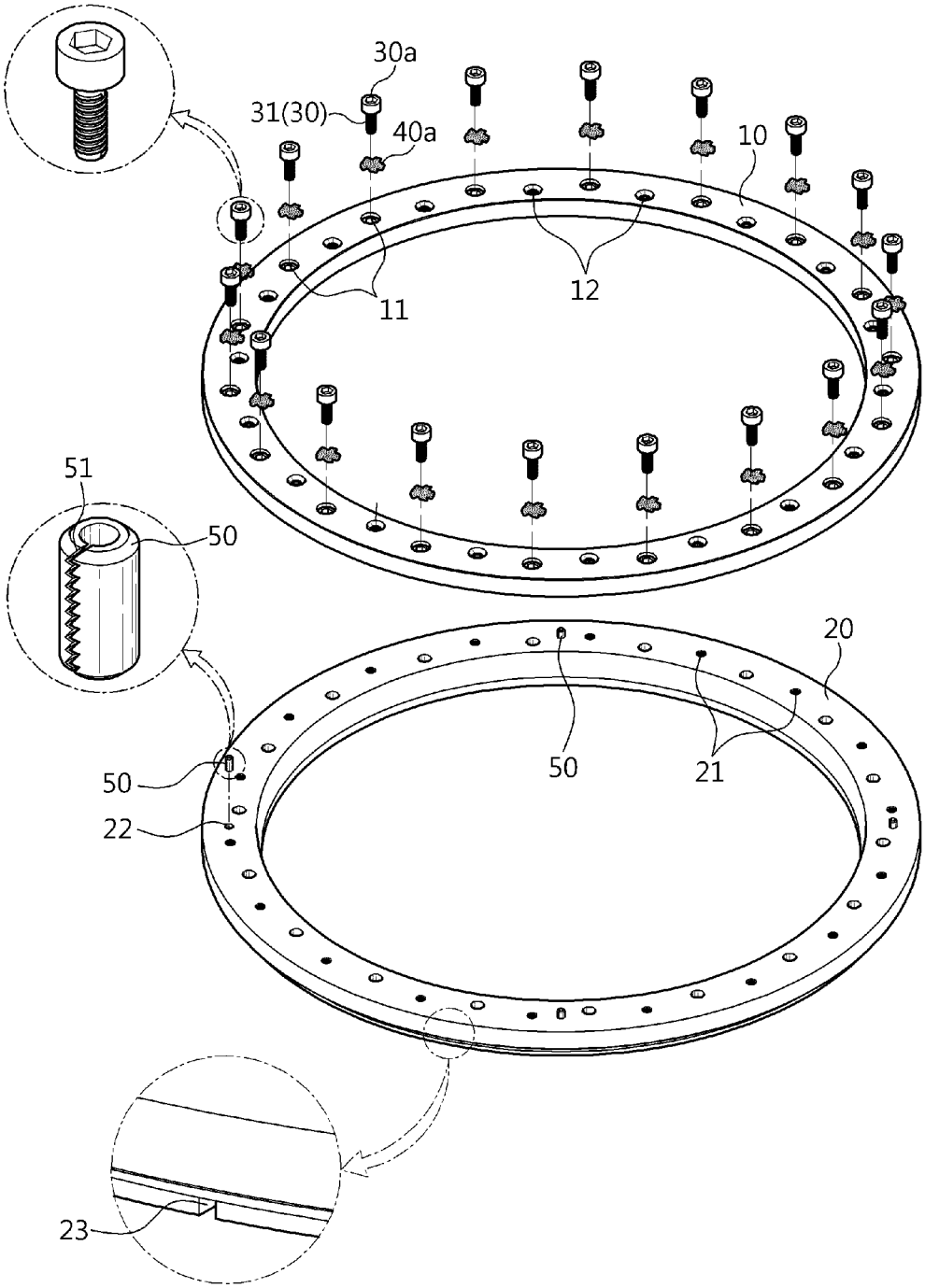
FIG. 2 is an exploded perspective view illustrating a retainer ring of a chemical-mechanical polishing apparatus according to the present invention.

Referring to FIG. 2, the retainer ring of a chemical-mechanical polishing apparatus according to the present invention includes: a first ring body 10 mounted on the chemical-mechanical polishing apparatus; and a second ring body 20 coupled to the bottom surface of the first ring body 10.

The first ring body 10 is mounted on the head of the chemical-mechanical polishing apparatus, and is formed of a metal material, for example, an SUS material. The first ring body 10 is formed of a metal material, and is firmly mounted on the head. The first ring body 10 can obtain weight and strength standards required for the corresponding chemical-mechanical polishing apparatus.

In addition, the second ring body 20 is coupled to the bottom surface of the first ring body 10, with the bottom surface of the second ring body 20 adjoining a polishing pad of the chemical-mechanical polishing apparatus. The second ring body 20 has abrasive supply holes 23 in the bottom surface thereof, through which abrasive is supplied into the retainer ring. A plurality of abrasive supply holes 23 spaced apart from each other is formed in the bottom surface of the second ring body 20, whereby the abrasive can be reliably supplied to interior of the second ring body 20, i.e. the space within the inner circumference of the second ring body 20 in which the wafer is accommodated.

The second ring body 20 is formed of a synthetic resin material, for example, polyphenylene sulfide. It should be understood that the second ring body 20 may be formed of one selected from among known engineering plastic materials, such as polyether ether ketone (PEEK), polyphenylene sulfide (PPS), polyamide, polybenzimidazole (PBI), polycarbonate, acetal, polyether amide (PEI), polybutylene terephthalate (PBT), polyethylene terephthalate (PET), and the like.

For example, the second ring body 20 is fabricated as an integral body formed of one of the above-rendered synthetic resins. Although not shown, the second ring body 20 may include a ring insert formed of metal and a ring sheath surrounding the outer circumference of the ring insert. The ring insert is disposed within the ring sheath. That is, the ring sheath surrounds the outer circumference of the ring insert such that the ring insert is not exposed externally.

The ring insert is formed of, for example, an SUS material, and the ring sheath is formed of, for example, polyphenylene sulfide. It should be understood that the ring sheath may be formed of one selected from among known engineering plastic materials, such as pyrolytic boron nitride (PBN), polyether ether ketone (PEEK), polyphenylene sulfide (PPS), polyamide, polybenzimidazole (PM), polycarbonate, acetal, polyether amide (PEI), polybutylene terephthalate (PBT), polyethylene terephthalate (PET), and the like.

The first ring body 10 has a plurality of mounting portions 12 spaced apart from each other. Head mounting members are fitted into and coupled to the mounting portions 12 such that the retainer ring is mounted to the polishing head of the chemical-mechanical polishing apparatus. The plurality of mounting portions 12 may be formed as holes or recesses. By way of example, each of the mounting portions 12 has female threads to be fastened with a bolt, such that the first ring body 10 is mounted to the polishing head of the chemical-mechanical polishing apparatus via bolt fastening.

The first ring body 10 has a plurality of engagement holes 11 that penetrate therethrough in the top-bottom direction and are spaced apart from each other. The engagement holes 11 are holes through which fixing members 30 pass, fixedly mounting the second ring body 20 to the bottom surface of the first ring body 10.

By way of example, the engagement holes 11 are formed separately from the mounting portions 12 and are disposed to alternate with the mounting portions 12.

The first ring body 10 may have the mounting portions 12 formed integral with the engagement holes 11 without having the engagement holes 11. Female threads may be formed in the inner circumferential surfaces of the engagement holes 11, allowing the first ring body to be mounted on the polishing head of the chemical-mechanical polishing apparatus.

The second ring body 20 has a plurality of engagement recesses 21 connected to the engagement holes 11. The engagement recesses 21 are recesses with which the fixing members 30 are engaged such that the second ring body 20 is fixedly mounted to the bottom surface of the first ring body 10.

The fixing members 30 are engaged with the engagement recesses 21 by extending through the engagement holes 11, thereby bringing the second ring body 20 into close contact with the bottom surface of the first ring body 10 such that the second ring body 20 is firmly and fixedly mounted thereto. It is preferable that the fixing members 30 be fixing bolt members 31 that are fastened to the engagement recesses 21 by extending through the engagement holes 11. The fixing bolt members 31 are screwed into the engagement recesses 21 such that the second ring body 20 can be simply and fixedly mounted to the bottom surface of the first ring body 10. The fixing bolt members 31 are firmly and fixedly mounted to the first ring body 10 by screwing force. The engagement recesses 21 have threads formed in the inner circumferential surface with which fixing bolt members 31 are fastened.

Bonding parts 40 bonding and fixing the fixing members 30 are respectively disposed within the engagement holes 11 or the engagement recesses 21. Each of the bonding parts 40 has a predetermined amount of adhesive 40*a* injected into a corresponding engagement hole of the engagement holes 11 or a corresponding engagement recess of the engagement recesses 21. After the adhesive 40*a* is injected, a corresponding fixing member of the fixing members 30 is engaged with the corresponding engagement hole 11 or the corresponding engagement recess 21, such that the fixing member 30 is fixedly bonded to the first ring body 10 or the second ring body 20 within the engagement hole 11 or the engagement recess 21.

The second ring body 20 can be firmly fixed to the first ring body 10 by means of the fixing members 30 and the bonding parts 40.

In addition, it is preferable that the retainer ring of a chemical-mechanical polishing apparatus according to the present invention further includes position-fixing members 50 fixing the first ring body 10 and the second ring body 20 in position such that the engagement holes 11 respectively communicate with the engagement recesses 21.

A portion of each of the position-fixing members 50 between the first ring body 10 and the second ring body 20 is fitted into the first ring body 10 and the remaining portion of each of the position-fixing members 50 is fitted into the second ring body 20.

The second ring body 20 has second position-fixing recesses 22 in the top surface thereof, into which the position-fixing members 50 are fitted.

Figure 3:
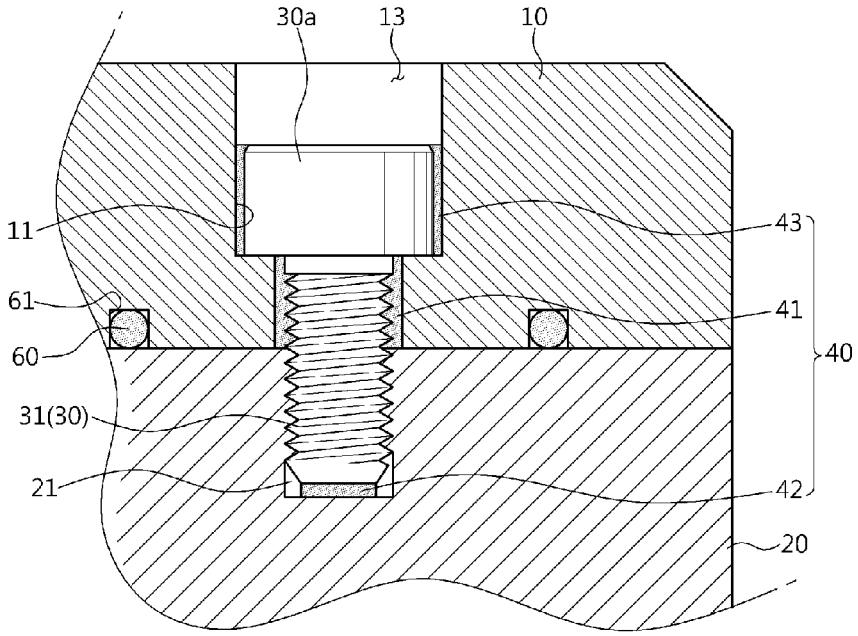
FIGS. 3 and 4 are cross-sectional views illustrating an exemplary embodiment of the retainer ring of a chemical-mechanical polishing apparatus according to the present invention.

Referring to FIG. 3, the inner diameter of the engagement holes 11 is greater than the inner diameter of the engagement recesses 21. In the position in which the fixing members 30 are engaged with the engagement recesses 21, the inner circumferential surfaces of the engagement holes 11 are spaced apart from the outer circumferential surfaces of the fixing members 30. Each of the bonding part 40 includes an upper bonding portion 41 disposed in the space defined between the inner circumference of a corresponding engagement hole of the engagement holes 11 and the outer circumference of a corresponding fixing member of the fixing members 30.

In addition, each of the fixing members 30 has a head 30*a* on the top end thereof. The first ring body 10 has head-accommodating portions 13 respectively communicating with the engagement holes 11. The head 30*a* is fitted into a corresponding head-accommodating portion of the head-accommodating portions 13. The inner diameter of the head-accommodating portion 13 is greater than the inner diameter of the head 30*a*, the inner circumferential surface of the head-accommodating portion 13 is spaced apart from the outer circumferential surface of the head 30*a*. Each of the bonding parts 40 has a head-bonding portion 43 disposed between the inner circumferential surface of the head-accommodating portion 13 and the outer circumferential surface of the head 30*a*.

In addition, the bottom ends of the fixing members 30 are spaced apart from the bottom surfaces of the engagement recesses 21. Each of the bonding parts 40 includes a lower bonding portion 42 disposed in the space defined between the bottom end of a corresponding fixing member of the fixing members 30 and the bottom surface of a corresponding engagement recess of the engagement recesses 21. When each of the fixing members 30 is engaged with a corresponding engagement recess 21 such that the head 30*a* is fitted into and seated in the head-accommodating portion 13, the bottom end of the fixing member 30 is spaced apart from the engagement recess 21, thereby defining a space therebetween. The lower bonding portion 42 is formed in the space between the bottom end of the fixing member 30 and the engagement recess 21.

It is preferable that O-rings 60 be interposed between the first ring body 10 and the second ring body 20. For example, the first ring body 10 has O-ring recesses 61 into which the O-rings 60 are fitted. The O-rings 60 are fitted into the O-ring recesses 61 and are in close contact with top surface portions of the second ring body, thereby providing seals between the first ring body 10 and the second ring body 20. The O-rings 60 are disposed on at least one side of the inner side and the outer side of the first ring body 10 and the second ring body 20 with respect to the portions with which the fixing members 30 are engaged. It is more preferable that the O-rings 60 be disposed on both the inner side and the outer side.

The O-rings 60 prevent slurry from entering between the first ring body 10 and the second ring body 20 during the chemical-mechanical polishing of the wafer such that the slurry does not enter the portions with which the fixing members 30 are engaged. The O-rings 60 prevent slurry from entering the inner diameter side or the outer diameter side of the retainer ring.

A more detailed description regarding the case in which the fixing members 30 are the fixing bolt members 31 will now be given.

Figure 4:
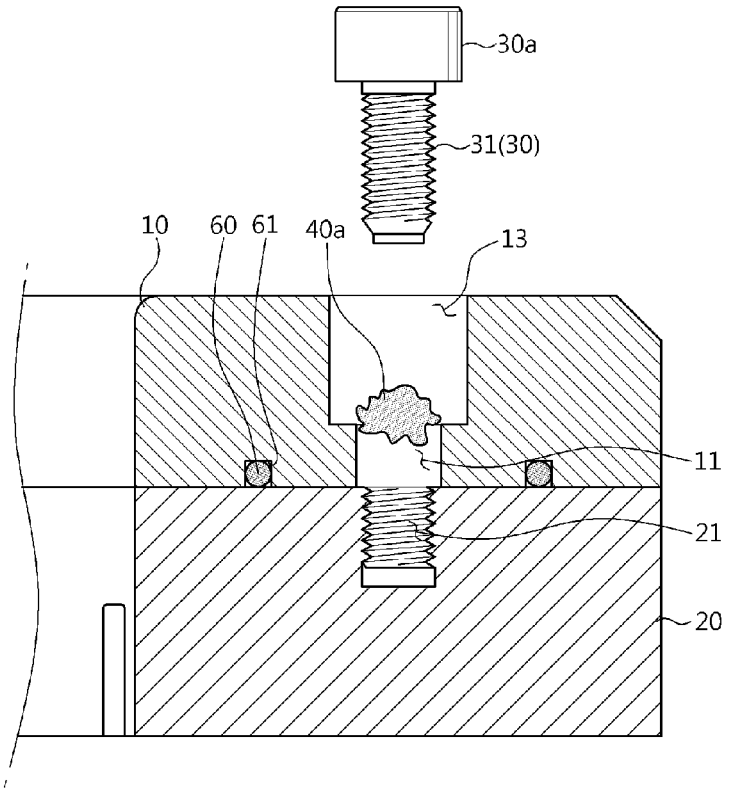

Referring to FIG. 4, the adhesive 40*a* is injected by a predetermined amount or more into the engagement hole 11 to close the engagement recess 21, and the fixing bolt member 31 is fastened with the engagement recess 21 through the engagement hole 11. Consequently, the adhesive 40*a* is filled in the space defined between the inner circumference of the engagement hole 11, i.e. the inner circumferential surface of the engagement hole 11, and the outer circumference of the fixing bolt member 31, i.e. the outer circumferential surface of the fixing bolt member 31, thereby forming the upper bonding portion 41.

In addition, when the fixing bolt member 31 is fastened with the engagement recess 21 such that the head 30*a* is seated within and caught by the space defined between the head-accommodating portion 13, the adhesive 40*a* is filled in the space between the outer circumference of the head 30*a*, i.e. the outer circumferential surface of the head 30*a*, and the inner circumference, i.e. the inner circumferential surface of the head-accommodating portion 13, thereby forming the head-bonding portion 43.

In addition, the fixing bolt member 31 is fastened with the engagement recess 21, and the head 30*a* is seated in and caught by the head-accommodating portion 13. In this position, the adhesive 40*a* is filled in the space defined between the bottom end of the fixing bolt member 31 and the bottom of the engagement recesses 21, thereby forming the lower bonding portion 42.

The upper bonding portion 41, the head-bonding portion 43, and the lower bonding portion 42 fixedly bond the fixing bolt member 31 to the first ring body 10 and the second ring body 20, such that the second ring body 20 can be more firmly mounted and fixed to the first ring body 10. This prevents the fastening force of the bolt member 31 from decreasing during the chemical-mechanical polishing of the wafer, thereby preventing damage to the wafer that would otherwise occur when the fastening force of the bolt member 31 is decreased.

The position-fixing members 50 fix the position of the first ring body 10 and the position of the second ring body 20 such that the inner circumference of the engagement holes 11 is positioned outside of and spaced apart from the inner circumference of the engagement recesses 21. It is more preferable that the position of the first ring body 10 and the position of the second ring body 20 are fixed such that each of the engagement recesses 21 is concentric with a corresponding engagement hole 11, whereby the spaces can be uniformly formed around the fixing bolt members 31 and the heads 30*a* extending through the engagement holes 11.

Figure 5:
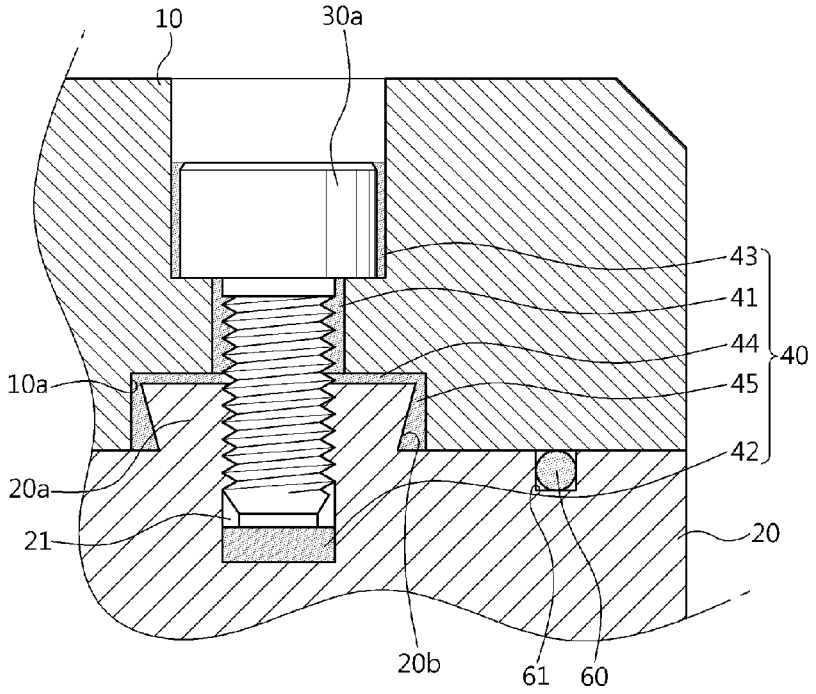
FIGS. 5 to 7 are cross-sectional views illustrating another exemplary embodiment of the retainer ring of a chemical-mechanical polishing apparatus according to the present invention.
Figure 6:
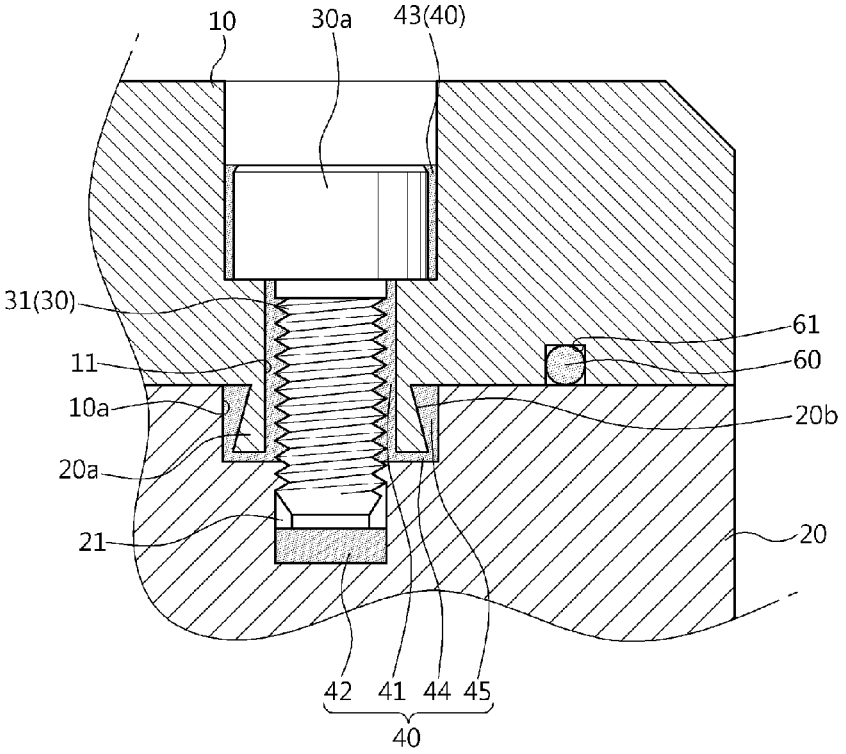

Referring to FIG. 5, the second ring body 20 has protrusions 20*a* protruding from upper surface portions thereof, in each of which a corresponding engagement recess 21 is formed. The first ring body 10 has protrusion-accommodating recesses 10*a* in lower surface portions thereof, in each of which a corresponding engagement hole 11 is formed, and a corresponding protrusion 20*a* is accommodated. Alternatively, referring to FIG. 6, the first ring body 10 has protrusions 20*a* on lower surface portions thereof, in each of which a corresponding engagement hole 11 is formed. The second ring body 10 has protrusion-accommodating recesses 10*a* in upper surface portions thereof, in each of which a corresponding engagement recess 21 is formed, and a corresponding protrusion 20*a* is accommodated.

Specifically, each of the protrusions 20*a* is formed on one of the lower portion of the first ring body 10 and the upper portion of the second ring body 20 such that each of the protrusions 20*a* communicates with one of a corresponding engagement hole 11 and a corresponding engagement recess 21. A corresponding protrusion-accommodating recess 10*a* is formed in the other one of the lower portion of the first ring body 10 and the upper portion of the second ring body 20. The corresponding protrusion-accommodating recess 10*a* communicates with the other one of the corresponding engagement hole 11 and the corresponding engagement recess 21, and the protrusion 20*a* is accommodated in the corresponding protrusion-accommodating recess 10*a*.

The size of the protrusions 20*a* is determined such that the outer circumferential surface of the protrusion 20*a* is spaced apart from the inner circumferential surface of the protrusion-accommodating recess 10*a*. Specifically, the depth of the protrusion-accommodating recess 10*a* is greater than the height of the protrusion 20*a*, and the inner diameter of the protrusion-accommodating recess 10*a* is greater than the outer diameter of the protrusion 20*a*.

It is preferable that the engagement recess 21 is formed in the central portion of the protrusion 20*a*, and that the protrusion-accommodating recess 10*a* is concentric with the engagement hole 11. When the fixing bolt member 31 is fastened with the engagement recess 21, a space is uniformly defined around the outer circumference of the protrusion 20*a*, spaced apart from the inner circumference of the protrusion-accommodating recess 10*a*.

Each of the bonding parts 40 may further include a first protrusion-bonding portion 44 disposed between the top surface of the protrusion 20*a* and the inner surface of the protrusion-accommodating recess 10*a*. When the fixing bolt member 31 is fastened with the engagement hole 11 through the engagement hole 11, a space is defined between the top surface of the protrusion 20*a* and the inner surface of the protrusion-accommodating recesses 10*a*, and the adhesive 40*a* is filled in the space, thereby forming the first protrusion-bonding portion 44.

In addition, the bonding part 40 may further include a second protrusion-bonding portion 45 disposed between the outer surface of the protrusion 20*a* and the inner surface of the protrusion-accommodating recess 10*a*. When the fixing bolt member 31 is fastened with the engagement hole 11 through the engagement hole 11, a space is defined between the outer circumference of the protrusion 20*a* and the inner circumference of the protrusion-accommodating recess 10*a*, and the adhesive 40*a* is filled in the space, thereby forming the second protrusion-bonding portion 45.

Furthermore, the protrusion 20*a* has a catch recess 20*b* on the outer side portion. The second protrusion-bonding portion 45 is filled in the catch recess 20*b*. Specifically, the second protrusion-bonding portion 45 is filled in and caught by the catch recess 20*b*, thereby more firmly fixing and mounting the first ring body 10 and the second ring body 20 to each other.

Figure 7:
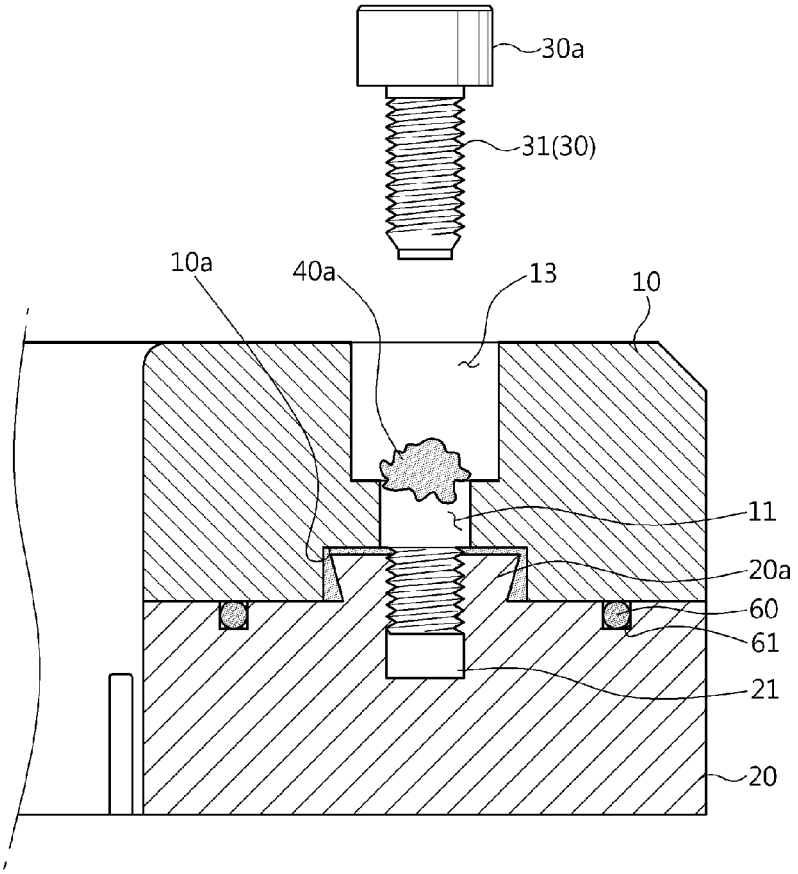

Referring to FIG. 7, the adhesive 40*a* is injected in a predetermined amount or more into the engagement hole 11 to close the engagement recess 21. The fixing bolt member 31 is fastened with the engagement recess 21 through the engagement hole 11. Consequently, the adhesive 40*a* is filled in the space between the inner circumferential surface of the engagement hole 11 and the outer circumferential surface of the fixing bolt member 31, in the space between the outer circumferential surface of the head 30*a* and the inner circumferential surface of the head-accommodating portion 13, in the space between the bottom end of the fixing bolt member 31 and the bottom of the engagement recess 21, and in the space between the top surface of the protrusion 20*a* and the inner surface of the protrusion-accommodating recesses 10*a*, thereby forming the upper bonding portion 41, the head-bonding portion 43, the lower bonding portion 42, the first protrusion-bonding portion 44, and the second protrusion-bonding portion 45.

The upper bonding portion 41, the head-bonding portion 43, the lower bonding portion 42, the first protrusion-bonding portion 44, and the second protrusion-bonding portion 45 fixedly bond the fixing bolt member 31 to the first ring body 10 and the second ring body 20.

Thus, the second ring body 20 can be more firmly mounted and fixed to the first ring body 10 due to the upper bonding portion 41, the head-bonding portion 43, the lower bonding portion 42, the first protrusion-bonding portion 44, and the second protrusion-bonding portion 45. This can reliably prevent the fastening force of the fixing bolt member 31 from decreasing during the chemical-mechanical polishing of a wafer, thereby reliably preventing an accident that would otherwise be caused by the decreased fastening force of the fixing bolt member 31.

Figure 8:
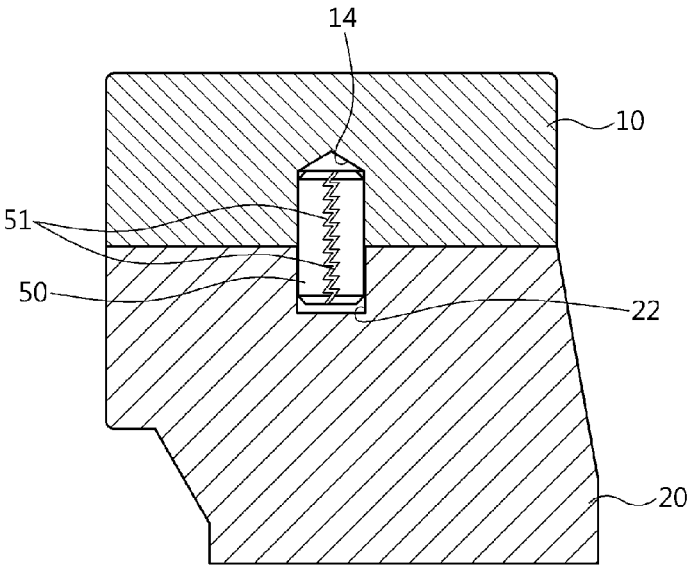
FIG. 8 is a cross-sectional view illustrating a further exemplary embodiment of the retainer ring of a chemical-mechanical polishing apparatus according to the present invention.

Referring to FIG. 8, a portion of each of the position-fixing members 50 is fitted into a corresponding first position-fixing recess 14 formed in the bottom surface of the first ring body 10, and the remaining portion of each of the position-fixing members 50 is fitted into a corresponding second position-fixing recess 22 formed in the upper surface of the second ring body 20.

A plurality of first position-fixing recesses 14 spaced apart from each other is formed in the bottom surface portions of the first ring body 10. A plurality of second position-fixing recesses 22 spaced apart from each other is formed in the top surface portions of the second ring body 20. When the first position-fixing recesses 14 are aligned with the second position-fixing recesses 22, the engagement holes 11 are positioned to communicate with the engagement recesses 21.

The position-fixing members 50 are fabricated separately from the first ring body 10 and the second ring body such that the position-fixing members 50 can be separated therefrom. For example, each of the position-fixing members 50 is coupled to one of a corresponding first position-fixing recess 14 and a corresponding second position-fixing recess 22, and in this position, is coupled to the other one of the first position-fixing recess 14 and the second position-fixing recess 22.

Each of the position-fixing members 50 has a cylindrical shape, with opposite radial ends being spaced apart from each other. A plurality of teeth 51 protruding from one of the opposite radial ends engages with a plurality of teeth 51 protruding from the other one of the opposite radial ends. The position-fixing member 50 has elasticity due to the spaced radial ends, and thus is firmly engaged with a corresponding first position-fixing recess 14 and a corresponding second position-fixing recess 22.

Specifically, the diameter of the position-fixing member 50 is reduced due to the spaced radial ends such that a portion thereof is engaged with the first position-fixing recess 14 and the remaining portion thereof is engaged with the second position-fixing recess 22.

After the position-fixing member 50 is engaged with the first position-fixing recess 14 and the second position-fixing recess 22, the position-fixing member 50 is more firmly engaged as the plurality of teeth 51 on one radial end is meshed with the plurality of teeth 51 on the other radial end, thereby more firmly coupling the first ring body 10 and the second ring body 20.

When the position-fixing member 50 is engaged with the first position-fixing recess 14 and the second position-fixing recess 22, the centers of the engagement holes 11 are aligned with the centers of the engagement recesses 21, such that the fixing bolt members 31 can be accurately fastened with the engagement recesses 21 through the engagement holes 11. Consequently, the spaces can be uniformly defined around the fixing bolt members 31, the heads 30*a*, and the protrusions 20*a*.

In the retainer ring of a chemical-mechanical polishing apparatus according to the present invention, the ring body mounted to the polishing head, and the ring body in contact with the polishing pad are simply and firmly assembled, thereby reducing the fabrication cost of the retainer ring and improving the productivity of the retainer ring.

In the retainer ring of a chemical-mechanical polishing apparatus according to the present invention, the ring body mounted to the polishing head, and the ring body in contact with the polishing pad are firmly fixed, thereby preventing damage to a semiconductor wafer during polishing. In addition, the retainer ring can be reliably used for the predetermined lifespan thereof.

Although the preferred embodiments of the present invention have been disclosed for illustrative purposes, a person skilled in the art will appreciate that various modifications, additions and substitutions are possible, without departing from the scope and spirit of the invention as disclosed in the accompanying claims.

What is claimed is:

1. A retainer ring disposed on a chemical-mechanical polishing apparatus and enclosing a wafer accommodated therein, the retainer ring comprising:

a first ring body disposed on the chemical-mechanical polishing apparatus, the first ring body having engagement holes formed in a top-bottom direction;

a second ring body disposed on a bottom surface of the first ring body, the second ring body having engagement recesses connected to the plurality of engagement holes;

fixing members extending through the engagement holes and engaged with the engagement recesses, thereby mounting the second ring body to the first ring body; and bonding parts disposed within the engagement holes or the engagement recesses, the bonding parts fixing the fixing members by being bonded thereto.

2. The retainer ring according to claim 1, wherein each of the bonding parts comprises an upper bonding portion disposed in a space defined between an inner circumferential surface of a corresponding engagement hole of the engagement holes and an outer circumferential surface of a corresponding fixing member of the fixing members.

3. The retainer ring according to claim 1, wherein each of the fixing members comprises a head on a top end thereof, the first ring body comprises head-accommodating portions in upper portions thereof, each of the head-accommodating portions communicating with a corresponding engagement hole of the engagement holes, and accommodating the head therein, an inner diameter of the head-accommodating portion being greater than an outer diameter of the head, and each of the bonding parts comprises a head-bonding portion disposed between an inner circumferential surface of the head-accommodating portion and an outer circumferential surface of the head.

4. The retainer ring according to claim 1, wherein each of the bonding parts comprises a lower bonding portion disposed in a space defined between a bottom end of a corresponding fixing member of the fixing members and a bottom surface of a corresponding engagement hole of the engagement holes.

5. The retainer ring according to claim 1, wherein each of the fixing members comprises a head on a top end thereof, the first ring body comprises head-accommodating portions in upper portions thereof, each of the head-accommodating portions communicating with a corresponding engagement hole of the engagement holes, and accommodating the head therein, an inner diameter of the head-accommodating portion being greater than an outer diameter of the head, and each of the bonding parts comprises:

an upper bonding portion disposed between an inner circumferential surface of a corresponding engagement hole of the engagement holes and an outer inner circumferential surface of a corresponding fixing member of the fixing members;

a head-bonding portion disposed between an inner circumferential surface of the head-accommodating portion and an outer circumferential surface of the head; and a lower bonding portion disposed in a space defined between a bottom end of a corresponding fixing member of the fixing members and a bottom surface of a corresponding engagement recess of the engagement recesses.

6. The retainer ring according to claim 1, wherein protrusions are formed on lower portions of the first ring body or upper portions of the second ring body, the protrusions respectively communicating with the engagement holes or the engagement recesses, and protrusion-accommodating recesses are formed in the upper portions of the second ring body or the lower portions of the first ring body, the protrusion-accommodating recesses respectively communicating with the engagement recesses or the engagement holes, and respectively accommodating the protrusions therein.

7. The retainer ring according to claim 6, wherein each of the bonding parts comprises:

a first protrusion-bonding portion disposed between an upper surface or a lower surface of a corresponding protrusion of the protrusions and an inner surface of a corresponding protrusion-accommodating recess of the protrusion-accommodating recesses; and a second protrusion-bonding portion disposed between an outer surface of the protrusion and an inner surface of the protrusion-accommodating recess.

8. The retainer ring according to claim 1, wherein each of the fixing members comprises a head on a top end thereof, the first ring body comprises head-accommodating portions in upper portions thereof, each of the head-accommodating portions communicating with a corresponding engagement hole of the engagement holes, and accommodating the head therein, an inner diameter of the head-accommodating portion being greater than an outer diameter of the head, protrusions are formed on lower portions of the first ring body or upper portions of the second ring body, the protrusions respectively communicating with the engagement holes or the engagement recesses, protrusion-accommodating recesses are formed in the upper portions of the second ring body or the lower portions of the first ring body, the protrusion-accommodating recesses respectively communicating with the engagement recesses or the engagement holes, and respectively accommodating the protrusions therein, and each of the bonding parts comprises:

an upper bonding portion disposed between an inner circumferential surface of a corresponding engagement hole of the engagement holes and an outer inner circumferential surface of a corresponding fixing member of the fixing members;

a head-bonding portion disposed between an inner circumferential surface of the head-accommodating portion and an outer circumferential surface of the head;

a lower bonding portion disposed in a space defined between a bottom end of a corresponding fixing member of the fixing members and a bottom surface of a corresponding engagement recess of the engagement recesses;

a first protrusion-bonding portion disposed between an upper surface or a lower surface of a corresponding protrusion of the protrusions and an inner surface of a corresponding protrusion-accommodating recess of the protrusion-accommodating recesses; and a second protrusion-bonding portion disposed between an outer surface of the protrusion and an inner surface of the protrusion-accommodating recess.

9. The retainer ring according to claim 1, wherein the fixing members are respectively engaged with the engagement recesses, respectively forming a space between an outer circumferential surface of each of the fixing members and an inner circumferential surface of a corresponding engagement hole of the engagement holes.

10. The retainer ring according to claim 1, wherein each of the fixing members comprises a head on a top end thereof, the first ring body comprises head-accommodating portions in upper portions thereof, each of the head-accommodating portions communicating with a corresponding engagement hole of the engagement holes, and accommodating the head therein, an inner diameter of the head-accommodating portion being greater than an outer diameter of the head, and the fixing member is engaged with a corresponding engagement recess of the engagement recesses, forming a space between an outer circumferential surface of the head and an inner circumferential surface of the head-accommodating portion.

11. The retainer ring according to claim 1, wherein protrusions are formed on lower portions of the first ring body or upper portions of the second ring body, the protrusions respectively communicating with the engagement holes or the engagement recesses, protrusion-accommodating recesses are formed in the upper portions of the second ring body or the lower portions of the first ring body, the protrusion-accommodating recesses respectively communicating with the engagement recesses or the engagement holes, and respectively accommodating the protrusions therein, and the fixing members are respectively engaged with the engagement recesses, respectively forming a space between an outer circumferential surface of each of the protrusions and an inner circumferential surface of a corresponding protrusion-accommodating portion of the protrusion-accommodating portions.

12. The retainer ring according to claim 1, further comprising an O-ring interposed the first ring body and the second ring body.

13. The retainer ring according to claim 12, wherein the O-ring is disposed on at least one side of an inner side and an outer side of the first ring body and the second ring body with respect to portions with which the fixing members are engaged.

14. The retainer ring according to claim 12, wherein the O-rings are disposed on both the inner side and the outer side of the first ring body and the second ring body with respect to the portions with which the fixing members are engaged.

15. The retainer ring according to claim 1, wherein the fixing members comprise fixing bolt members that are fastened with the engagement recesses through the engagement holes.

16. A retainer ring disposed on a chemical-mechanical polishing apparatus and enclosing a wafer accommodated therein, the retainer ring comprising:

a first ring body disposed on the chemical-mechanical polishing apparatus, the first ring body having engagement holes formed in a top-bottom direction;

a second ring body disposed on a bottom surface of the first ring body, the second ring body having engagement recesses connected to the plurality of engagement holes;

fixing members extending through the engagement holes and engaged with the engagement recesses, thereby mounting the second ring body to the first ring body; and a position-fixing member fixing the first ring body and the second ring body in position such that the engagement holes communicate with the engagement recesses, wherein a portion of the position-fixing member is fitted into the first ring body and a remaining portion of the position-fixing member is fitted into the second ring body.

17. The retainer ring according to claim 16, wherein an inner diameter of the engagement holes is greater than an inner diameter of the engagement recesses, and the position-fixing member fixes the first ring body and the second ring body in position such that the engagement recesses are respectively concentric with the engagement holes.

18. The retainer ring according to claim 16, wherein the position-fixing member has a cylindrical shape, with opposite radial ends thereof being spaced apart from each other, the opposite radial ends spaced apart from each other impart elasticity to the position-fixing member.

19. The retainer ring according to claim 18, wherein the position-fixing member comprises teeth on the opposite radial ends spaced apart from each other, the teeth on one of the opposite radial ends engaging with the teeth on the other one of the opposite radial ends.

* * * * *